United States Patent [19]

Stinnes

[11] 4,080,923

[45] Mar. 28, 1978

[54] ANCHOR WITH PIVOTAL SECONDARY FLUKES

[75] Inventor: Hanns Stinnes, Muelheim-Ruhr, Germany

[73] Assignee: Margrete Stinnes, Jackson Heights, N.Y.

[21] Appl. No.: 726,423

[22] Filed: Sep. 24, 1976

[30] Foreign Application Priority Data

Sep. 30, 1975 Germany ..... 2543559

[51] Int. Cl.[2] ..... B63B 21/24

[52] U.S. Cl. ..... 114/304; 114/303

[58] Field of Search ..... 114/294, 295, 297, 298, 114/299, 300, 301, 302, 303, 304, 305, 306, 307, 308, 309, 310; 16/172, 159, 167, 163, 128 R

[56] References Cited

U.S. PATENT DOCUMENTS

| | | | |
|---|---|---|---|
| 50,542 | 10/1865 | Marshall | 114/307 |
| 2,267,657 | 12/1941 | Korvin-Kroufovsky | 114/307 |
| 2,863,415 | 12/1958 | Schofibld | 114/303 |
| 3,712,259 | 1/1973 | Semolic | 114/303 |
| 3,822,666 | 7/1974 | Blomberg | 114/303 |

FOREIGN PATENT DOCUMENTS

| | | | |
|---|---|---|---|
| 544,852 | 4/1931 | Germany | 114/303 |
| 6,809,481 | 1/1970 | Netherlands | 114/304 |
| 1,375 of | 1880 | United Kingdom | 114/307 |
| 3,112 of | 1867 | United Kingdom | 114/307 |

*Primary Examiner*—Trygve M. Blix
*Assistant Examiner*—D. W. Keen
*Attorney, Agent, or Firm*—Michael J. Striker

[57] ABSTRACT

An anchor has a shank at whose crown end is provided a pair of main flukes defining a fluke plane. A stock is provided on the shank toward the ring end thereof and has a pair of arms extending oppositely from the shank and lying generally in a stock plane perpendicular to the fluke plane. A secondary fluke is pivotal on each of these arms between a pair of extreme positions forming an acute angle with the stock plane. In a central position the secondary flukes lie in the stock plane. In use the secondary flukes dig in first so as to pull the anchor downwardly and cause the main flukes to dig in, giving excellent grab.

13 Claims, 18 Drawing Figures

ANCHOR WITH PIVOTAL SECONDARY FLUKES

BACKGROUND OF THE INVENTION

The present invention relates to an anchor. More particularly this invention concerns an anchor securable to the end of an anchor line, chain or cable to moor a floating boat or the like relative to the bottom.

An anchor normally comprises a shank having a ring end adopted to be attached to the anchor line, chain or cable, and a crown end from which projects a pair of arms formed with flukes. In the commonest type of fixed-fluke anchor there is also provided toward the ring end of the shank a stock which lies in a plane perpendicular to the plane of the flukes. The purpose of this stock is to position the anchor relative to the bottom so that one of its flukes will be pointed into the bottom. Thus when a pull is exerted on the anchor line this pointing-down fluke should dig into the bottom and the anchor should therefore grab. Frequently, particularly when the bottom is rocky or quite hard, it is necessary to drag such a fixed-fluke anchor a considerable distance before it finally digs in and grabs. Even then if the current or wind shifts considerably it is possible for the anchor line to swing around and even engage the upwardly directed fluke so as to pull the anchor free so that the boat will drift until the anchor graps again.

In another well-known type of anchor, known under the trade name as a "Danforth" anchor, the flukes are pivotal on the crown end of the shank. Thus these flukes can pivot from a central position lying in a plane including the shank to either of two extreme positions at an angle to this plane and pointing generally toward the ring end of the shank. Such an anchor is dropped in and lies flat on the bottom. When it is pulled along the bills of the flukes eventually dig into the bottom and seat the anchor securely. Such an anchor is efficient in relatively soft bottoms, but when the bottom is relatively hard such anchors normally skid along a considerable distance before grabbing.

In all of the known anchor types it is standard practice to use a 7:1 scope, that is to employ a length of anchor line equal to seven times the depth where the anchor is placed. Furthermore a standard such anchor weighing between 5kg and 25kg normally is only rated for a pulling load in the anchor line of between 80kg and 120kg.

SUMMARY OF THE INVENTION

It is therefore an object of the present invention to provide an improved anchor.

Another object is to provide such an anchor which grabs readily in both soft and hard bottoms.

Yet another object is to provide an anchor with improved holding power.

A further object is the provision of an anchor which is virtually able to bury itself in the normal bottom.

These objects are attained according to the present invention in an anchor of the above-described general type having a shank at the crown end of which is provided a pair of main flukes lying in and defining a fluke plane including the shank. A stock is provided on the shank between the ends and has a pair of arms extending oppositely from the shank and lying generally in the stock plane generally perpendicular to the fluke plane and once again including the shank. A secondary fluke is pivotal on each of these arms between a pair of extreme positions forming an acute angle with the stock plane and through a central position in the stock plane. Thus when the anchor is dropped to the bottom it will lie in a position with one of its main flukes pointing into the bottom and the tips of both of its secondary flukes downwardly pointing into the bottom. A pull on the anchor line leading to horizontal displacement of the thus-positioned anchor will cause all three of these tips to dig into the ground so that at least one of them is insured a good purchase and the anchor will immediately grab. In most instances the secondary flukes will grab first, then the main fluke so that these three elements will all dig themselves firmly into the bottom until the shank assumes a position parallel to the bottom. When a severe pull is exerted on the anchor line it is possible for such an anchor to bury itself so deeply into the bottom that even its upstanding fluke is buried and the possibility of the anchor line catching on it and dislodging the anchor is almost entirely ruled out. Nontheless if the anchor line is pulled directly upwardly, vertically, this will have the effect of first withdrawing the secondary flukes and then the primary fluke from the bottom for easy retrieval of the anchor.

It has been found that with such an anchor weighing between 5kg and 25kg it is possible to achieve, rather than the normal pull resistance of between 80kg and 120kg, a pull resistance above 1000kg. Thus it is possible greatly to reduce anchor scope so that in tight moorings the possibility of swinging into nearby vessels or the like is greatly reduced. Furthermore such a good grab makes it possible to use a relatively small and light anchor even for a relatively large boat, and frequently eliminates the necessity of dropping several anchors. This is mainly due to the fact that the use of the secondary flukes adjacent the ring end of the anchor greatly reduces the lever arm which is applied to dislodge these flukes so that the holding power is increased by an extent far out of proportion to the simple increase in surface area of embedded flukes.

According to further features of this invention the stock is slidable along the anchor shank and can even be displaced into a position parallel to the main flukes for storage. Means is provided, such as a removable pin, for locking the flukes in position on the shank. It is similarly possible to provide a second such pair of main flukes. This latter provision allows the anchor to be used, stripped of its stock, as a grapnel.

According to another feature of this invention the secondary flukes are hinged on the arms of the stock. It is possible to achieve this by forming the arms each as a pair of parallel, hollow or solid rods and to engage the edge of the secondary fluke between the respective pair of rods. The outer ends of these rods are connected together by a link which may be formed as a stack of relatively large-diameter plates in order to prevent the stock ends from becoming wedged in the ground.

In accordance with yet another feature of this invention the shank, when it is over one meter long, is provided with a pair of such stocks each carrying a pair of such secondary flukes. It is therefore possible to enormously increase the holding power of such an anchor. In such an arrangement the stock closest to the ring end of the shank carries triangular flukes. The stock arms of the other stock are substantially longer and carry flukes having inner triangular portions and outer trapezoidal portions.

The anchor further comprises in accordance with other features of this invention a weight. This weight may be slidable along the anchor shank between the flukes and the stock. The weight has an eccentric bore that passes through it at a location offset from its center of mass so that this weight normally hangs downwardly from the shank. Thus when the anchor is dropped in the ground the weight will first assume a position adjacent the lower stock so as to urge the secondary flukes in, then as the anchor grabs it will slide back, being entrained frictionally by the bottom, until it presses against the fluke. It is also possible to provide a further such weight at the crown end of the anchor, this latter arrangement is particularly useful for very hard bottoms so as to increase the penetration of the anchor fluke into the bottom. With such a system the weight will normally sink into the bottom into the wake created by the flukes.

In accordance with this invention the flukes are hinged on the stock arms by relatively heavily dimensioned hinge rings. The pintles themselves of such hinges are formed by the stock arms. In addition the abutments which define the extreme positions of the secondary flukes are formed as relatively thin ribs on the secondary flukes and may even constitute the ends of reinforcing ribs thereof so that the possibility of a foreign body becoming wedged between the abutment and the respective surface of the stock so as to prevent the fluke from assuming its extreme position is considerably reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 7:
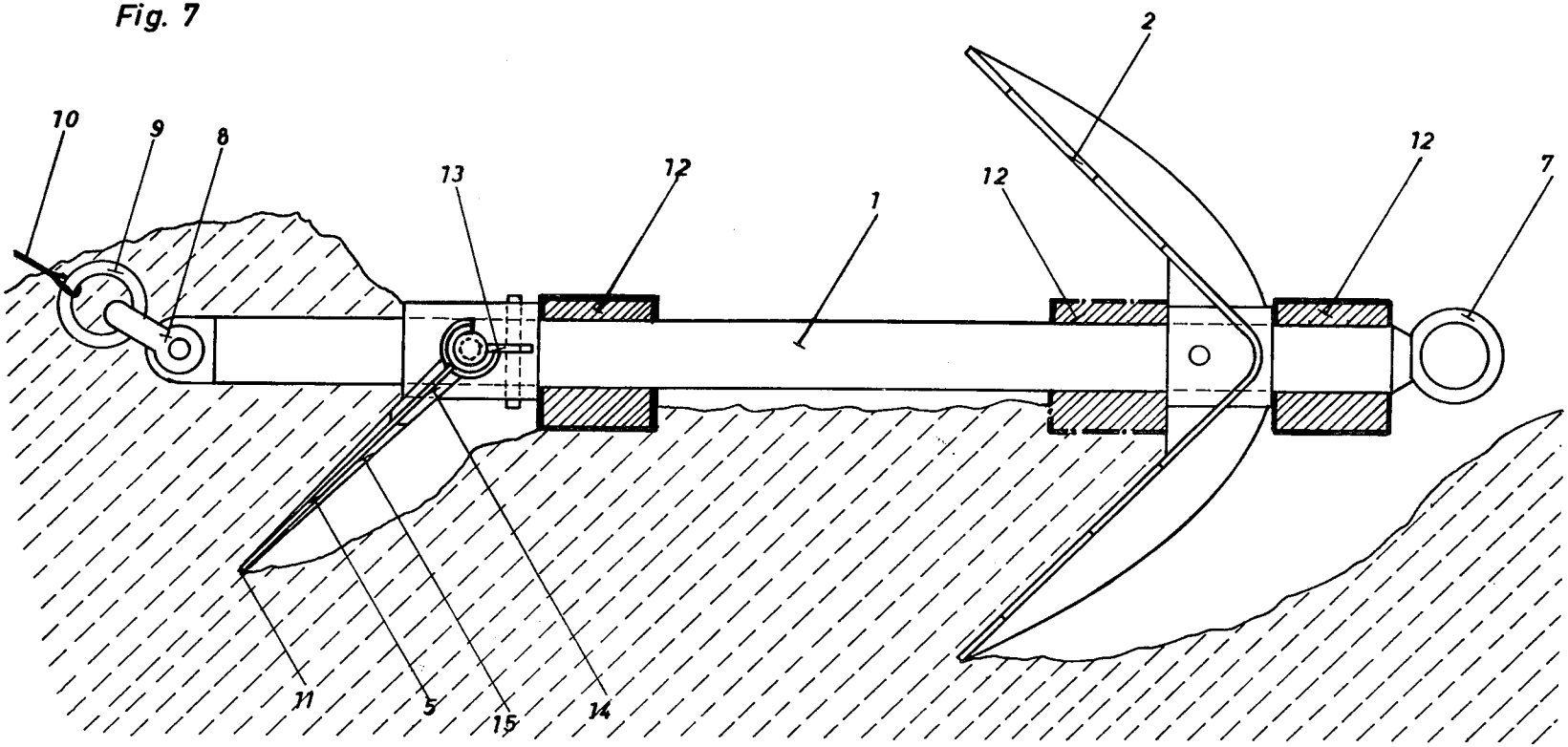
FIG. 7 is a view similar to FIG. 1 illustrating a third anchor in accordance with this invention.
Figure 7A:
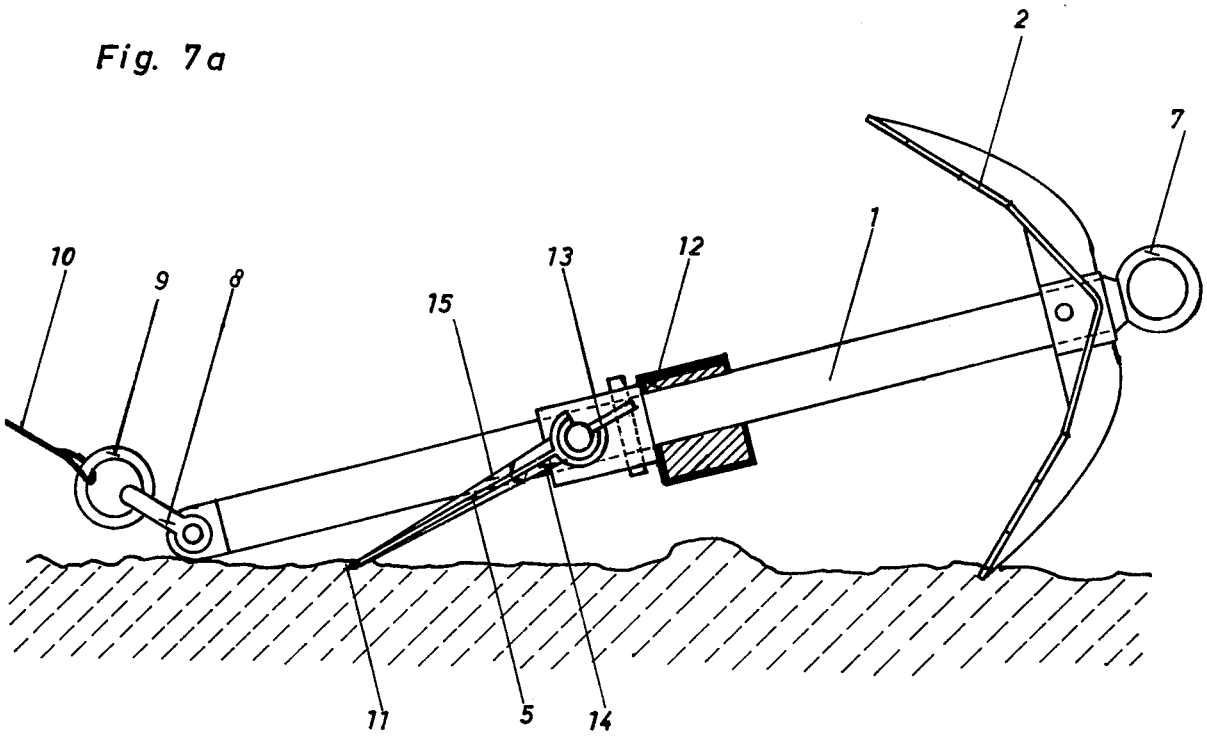
Figure 7B:
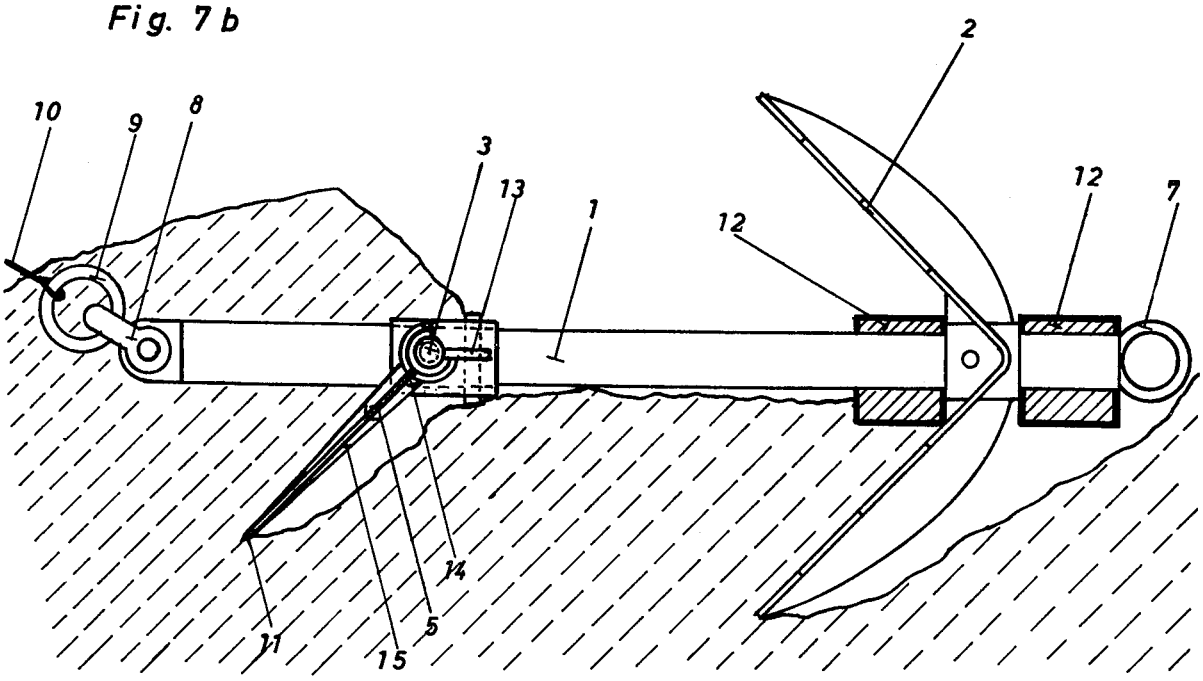
Figure 8:
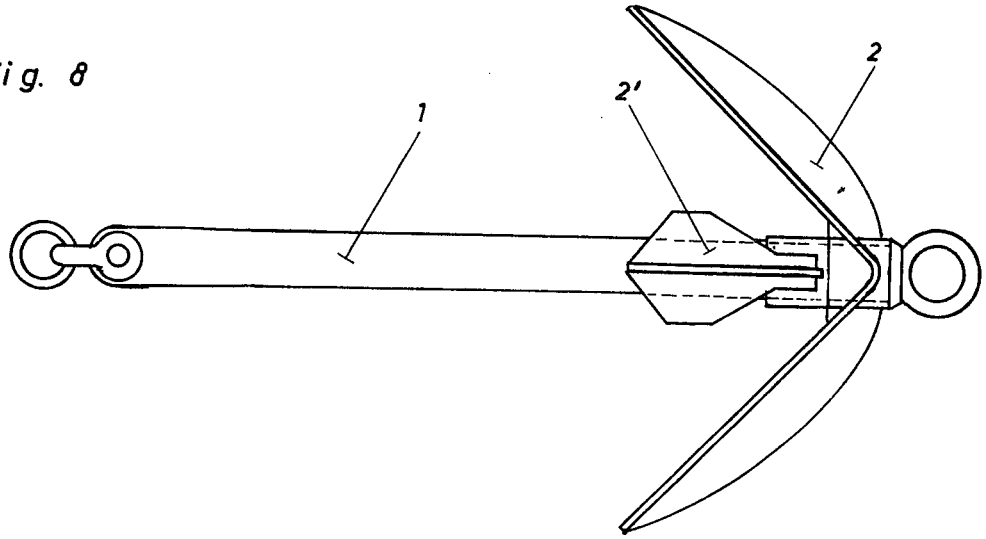
Figure 9:
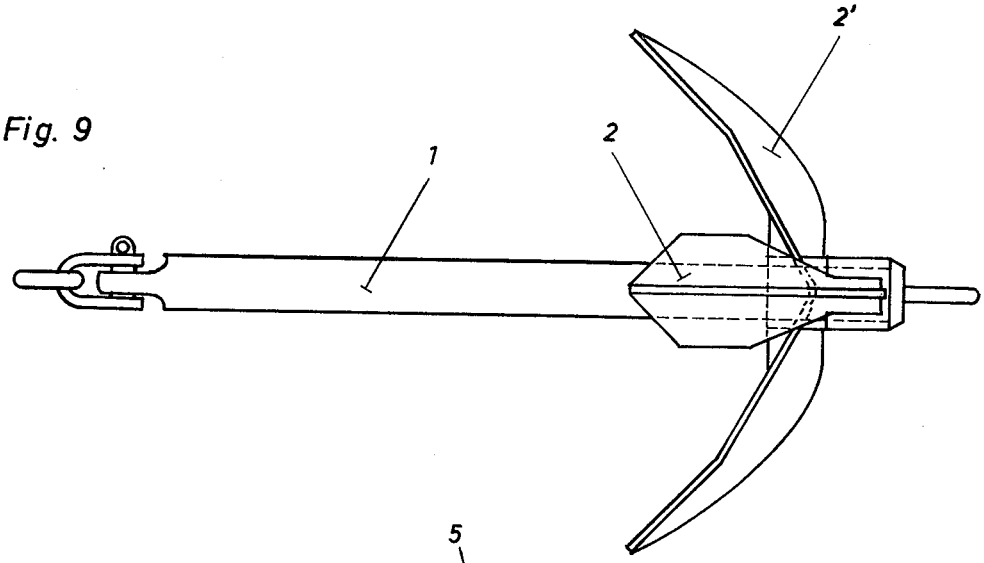
Figure 10:
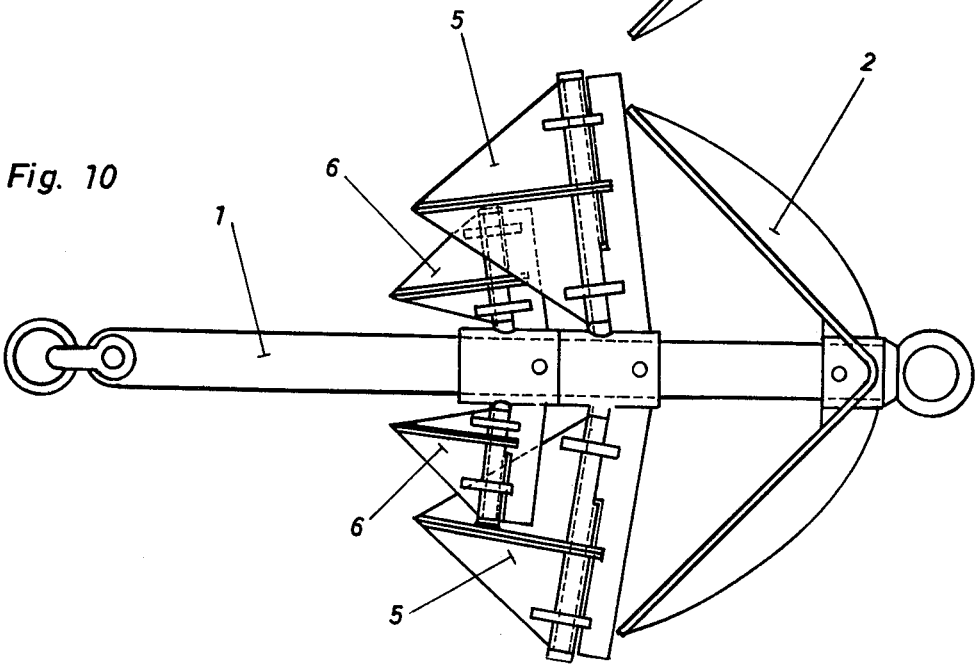
Figure 11:
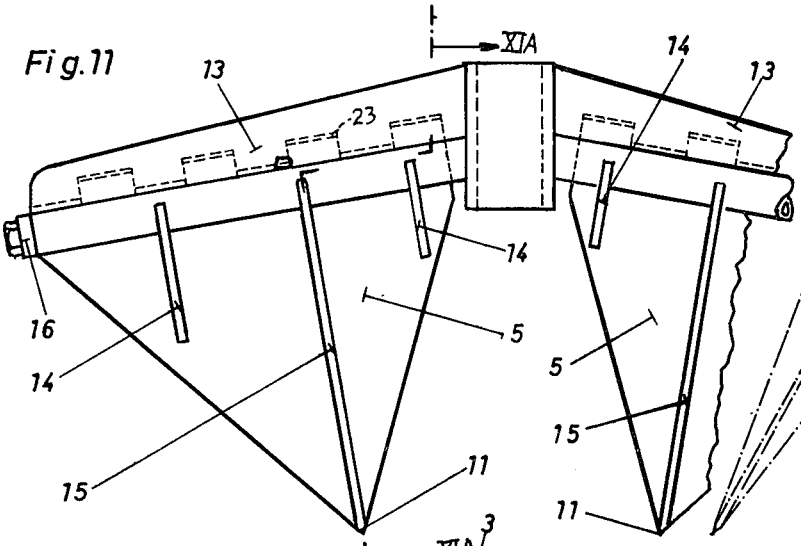
Figure 11A:
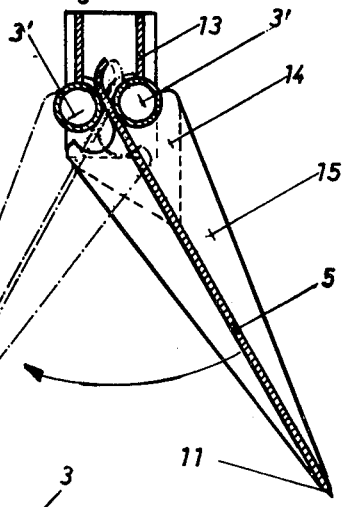
Figure 12:
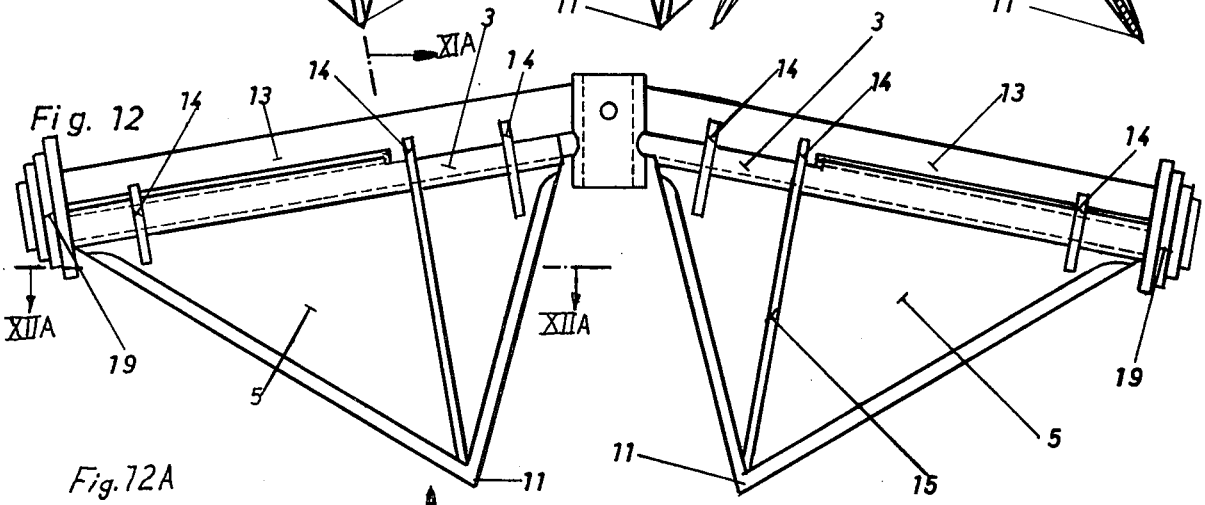
Figure 12A:
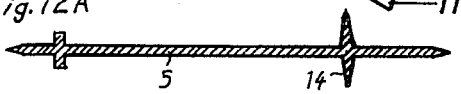
Figure 13:
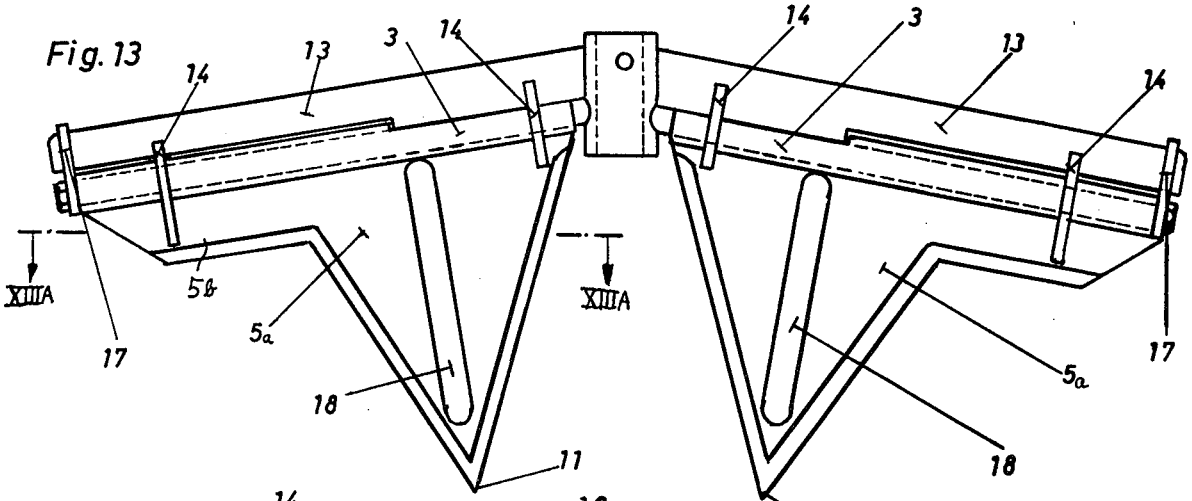
Figure 13A:
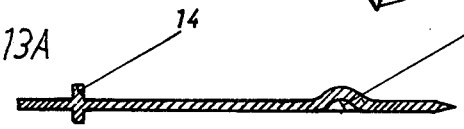

FIGS. *7a* and *7b* are views similar to FIG. 7 illustrating operation of the anchor of FIG. 7;

FIGS. 8 and 9 are side views illustrating another anchor in accordance with the present invention with the stock removed;

FIG. 10 is a top view of the anchor of FIGS. 3–6 shown in the storage position;

FIG. 11 is a top view partly broken away of a stock assembly according to this invention;

FIG. 11A is a section taken along XIA–XIA of FIG. 11;

FIG. 12 is a top view of yet another stock assembly in accordance with this invention;

FIG. 12A is a section taken along line XIIA–XIIA of FIG. 12;

FIG. 13 is a top view of a further stock assembly according to this invention; and FIG. 13A is a section taken along line XIIIA–XIIIA of FIG. 13.

DESCRIPTION OF THE PREFERRED EMBODIMENTS

Figure 1:
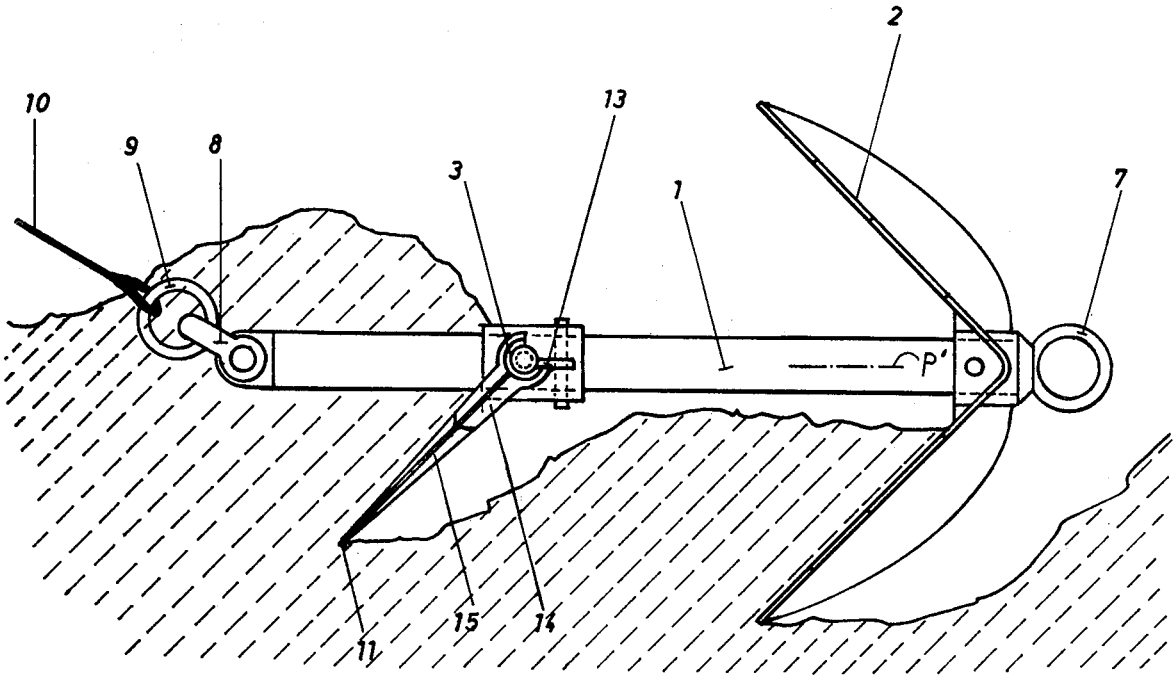
FIG. 1 is a vertical section through an anchor according to this invention as it grabs into the bottom.
Figure 2:
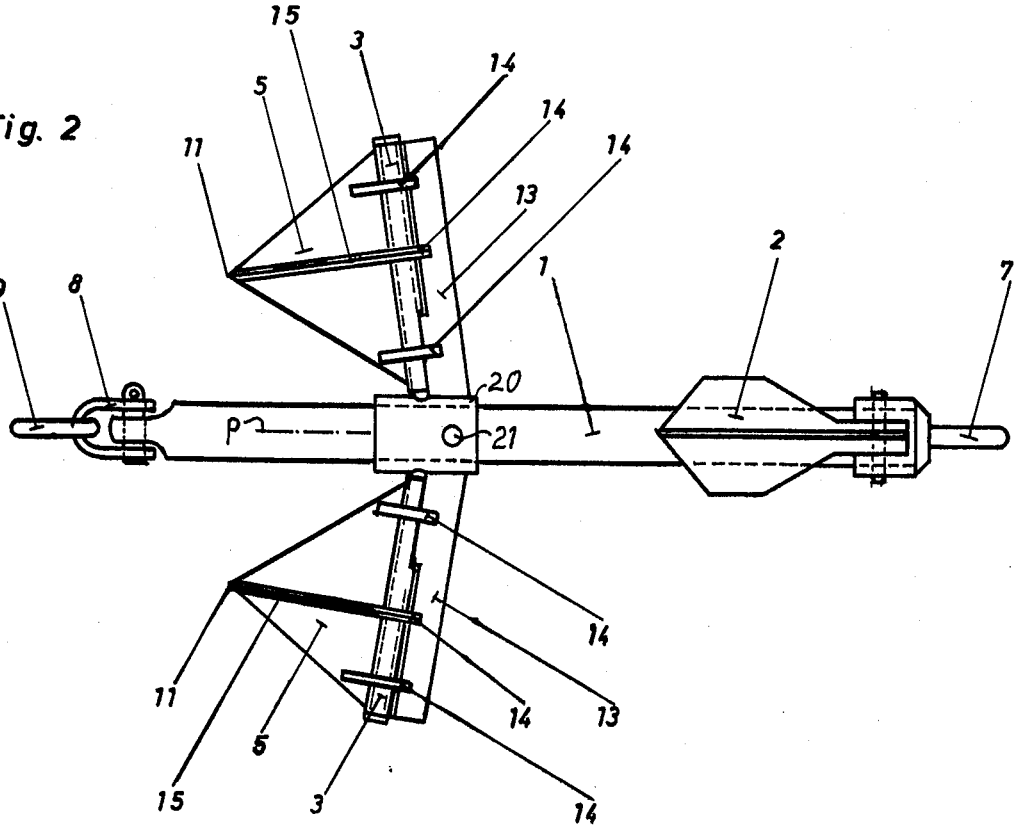
FIG. 2 is a top view of the anchor of FIG. 1.

As shown in FIGS. 1 and 2 an anchor has a hollow or solid shank 1 on which is provided a pair of flukes 2 defining a plane P on which the shank 1 also lies. A pair of stock arms 3 extends laterally from a collar 20 of cylindrical shape slidable along the shank 1 and securable thereon by means of a pin 21 so as to define a plane P′ which is perpendicular to the plane P. Each of these stock arms 3 forms an angle of approximately 80° with the shank 1 and is tilted away from the flukes 2.

A secondary fluke 5 of generally triangular shape is pivotal on each of these stock arms 3. In addition the anchor is provided at its one end with an eye 7 for connection to a trip line and at its other end with a shackle 8 carrying a ring 9 to which the anchor line or cable 10 is secured.

Each of the secondary flukes 5 has a point 11 and is formed with at least one stiffening rib 15 extending perpendicular to the respective arm 3 and terminating at the point 11. Furthermore each of the flukes 5 has a pair of lugs or eyes 14 engaging most of the way around the respective arm 3 and forming an abutment engageable with a stiffening rib 13 extending along the arm 3 on the side turned toward the flukes 2.

Figure 3:
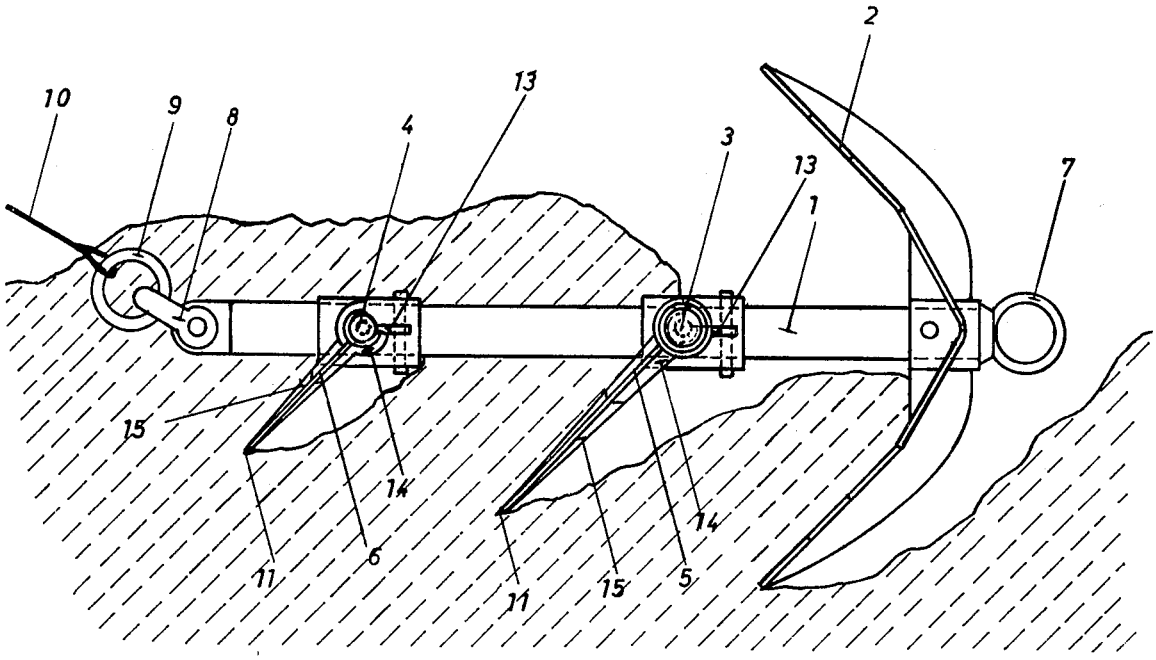
FIGS. 3 and 4 are views similar to FIGS. 1 and 2, respectively, showing a variant on the anchor of FIGS. 1 and 2.
Figure 4:
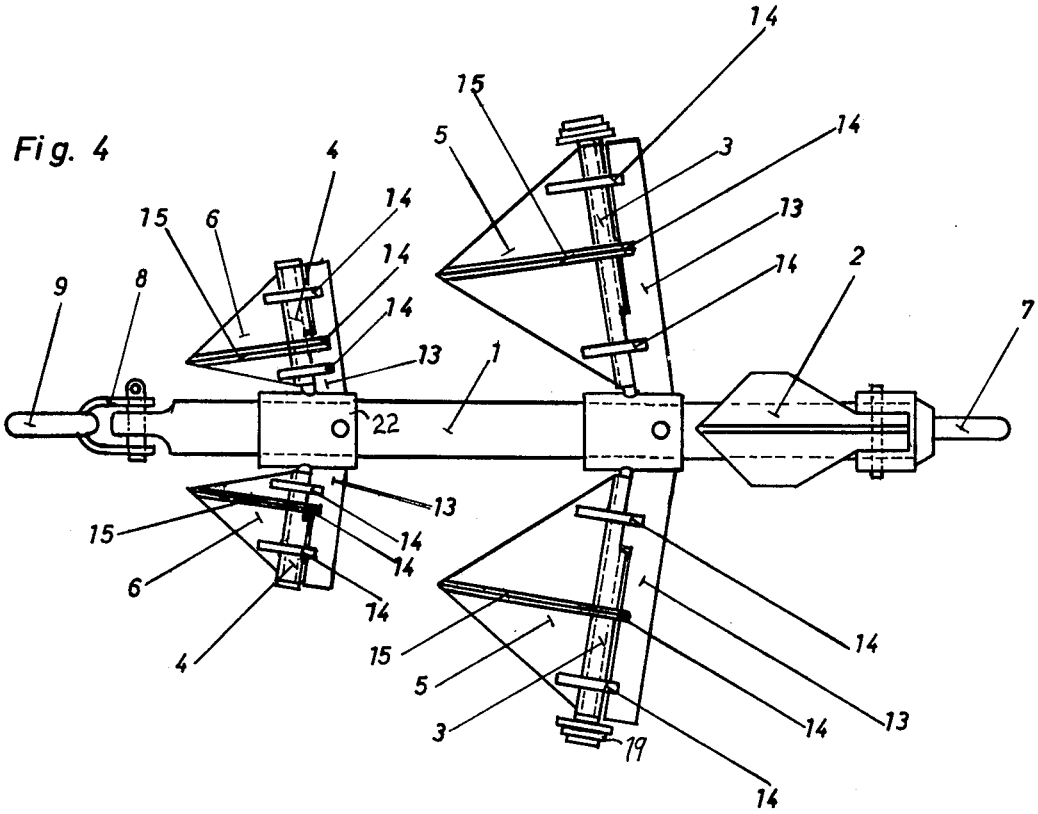
Figure 5:
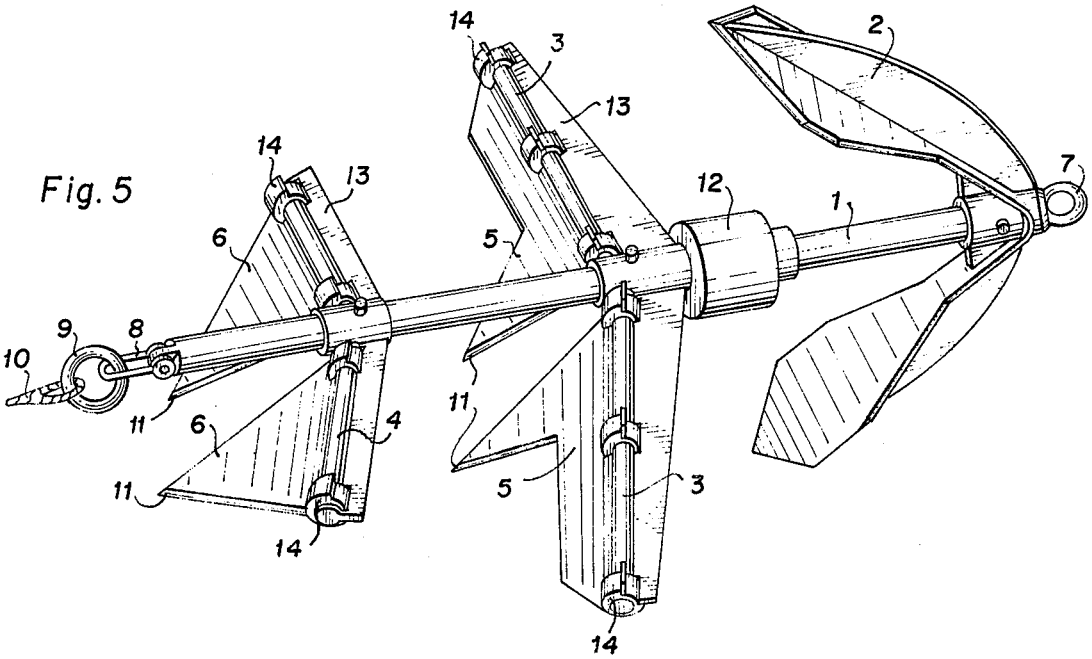
FIGS. 5 and 6 are perspective views illustrating operation of the anchor of FIGS. 3 and 4.
Figure 6:
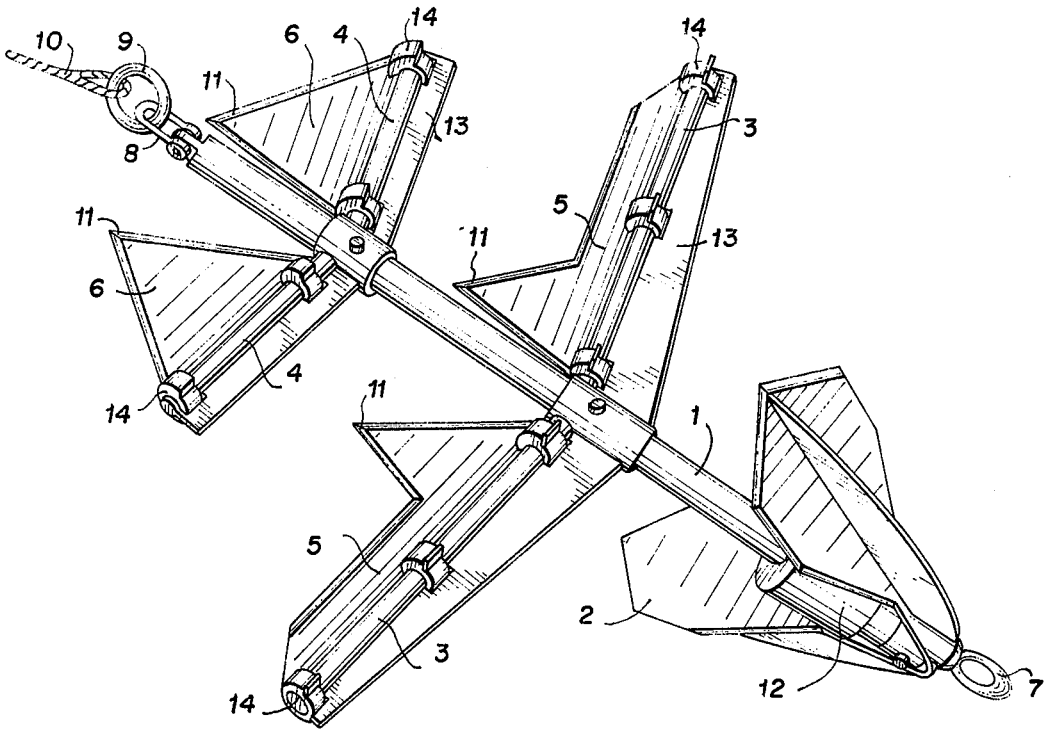

The arrangement shown in FIGS. 3 and 4 is substantially identical to that shown in FIGS. 1 and 2, with like structure having the same reference numerals. In this arrangement, however, a second collar 22 is provided carrying a second pair of stock arms 4 on which are pivotally mounted a further pair of secondary flukes 6. In other respect these flukes 6 are identical to the flukes 5, but are simply somewhat smaller and mounted on shorter arms 4.

The arrangement as shown in FIGS. *7–7b* is identical to that shown in FIGS. 1 and 2 except that a cylindrical steel weight 12 is provided. This weight 12 has an eccentric bore and is slidable along the shank 1 between the flukes 2 and the collar 21. A set screw may be provided to secure it at any location, and it is possible as shown in FIGS. 7 and *7b* to provide another such weight 12 between the flukes 2 and the eye 7.

The arrangements described above function in substantially the same manner. When dropped onto the bottom the position shown in FIGS. 5, 6 and *7a* will be assumed. A pull on the anchor line 10 tending to displace the anchor horizontally will cause first the tips 11 to bight into the bottom, pivoting them outwardly into their extreme positions. Further pulling will cause the flukes 2 similarly to dig into the bottom as shown in FIGS. 1, 3, 7 and *7b*. It is noted that when the weight 12 is provided this weight 12 is first effective at the secondary flukes 5, then becomes effective at the primary or main flukes 2 once the arrangement is horizontal. The eccentric bore in the weight 12 aids in its displacement, as the weight 12 will engage the bottom before the shank 1 does.

FIGS. 8 and 9 show how it is possible to remove the stock assembly from the shank 1 and provide a second set of flukes 2′ so that the arrangement can be used as a grapnel. These flukes 2′ have the same spread as the flukes 2 and have tips that lie in the same plane as the tips of the flukes 2.

Furthermore FIG. 10 shows how it is possible to remove the pins holding the two stock assemblies in place and slide them down toward the flukes 2 and into a position parallel to the plane P of these flukes 2. This allows relatively easy storage of the anchor in a compact condition.

FIGS. 11 and 11*a* show how the arm may be formed of a pair of parallel hollow rods or tubes 3' spaced apart and each having a respective rib 13. The inner edge of the flukes 5 is engaged between these hollow rods 3' and is formed with a plurality of oppositely directed tabs 23 which act as abutments engageable with the inside faces of the ribs 13. The outer ends of the rods 3' are interconnected by a bolted-on link 16 to make a very stable assembly, while allowing the flukes 5 to be removed relatively easily if desired. Such an arrangement has extreme strength and a long service life as the abutments 23 are well protected within the assembly, yet able to bear with good leverage on the rib 13.

In the arrangement of FIG. 12 the ends of the rod 3' constituting the arms 3 are covered with a cascaded succession of relatively large-diameter washers 19 so that these ends will not tend to dig into the bottom, preventing proper operation of the anchor.

FIGS. 13 and 13A show how, instead of triangular flukes 5 it is possible to employ flukes having a triangular section 5*a* and a trapezoidal section 5*b*. Such an arrangement is ideally suitable for the large pivotal flukes of the arrangements of FIGS. 5 and 6. In this arrangement there is also provided a stiffening welt 18 which takes the place of the ribs 15.

The anchor according to the present invention can be used to hold enormous loads. It grabs almost immediately when it is pulled horizontally along the bottom and can hold against virtually any type of force but a force directed directly upwardly. Indeed the anchor is capable of digging itself in so very deeply that the anchor line cannot engage on the upstanding fluke and pull it free.

It will be understood that each of the elements described above, or two or more together, may also find a useful application in other types of structures differing from the types described above.

While the invention has been illustrated and described as embodied in an anchor, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An anchor comprising:

a shank having a crown end and a ring end;

a pair of main flukes fixed at said crown end to said shank, generally lying in a fluke plane including said shank, and immovable relative to said shank;

a stock on said shank between said ends thereof and having a pair of arms extending oppositely from said shank, normally fixed rigidly on said shank, and lying generally in a stock plane generally perpendicular to said fluke plane and including said shank;

a secondary fluke pivotal on each of said arms between a pair of extreme positions forming an acute angle with said stock plane and through a central position in said stock plane, said secondary flukes being pivotal independently of each other and pointing generally toward said ring end in said extreme and central positions; and means including abutments on said arms engageable with said secondary flukes and defining therefor said extreme positions.

2. The anchor defined in claim 1, wherein said stock is displaceable along said shank, said anchor further comprising means for arresting said stock on said shank between the ends thereof.

3. The anchor defined in claim 1, wherein said secondary flukes are generally triangular.

4. The anchor defined in claim 3, wherein said secondary flukes have triangular and trapezoidal sections, the latter sections being further from said shank than the former sections.

5. The anchor defined in claim 1, wherein said secondary flukes have edges at and at least partially surrounding said arms for hinge-like action therebetween, each of said secondary flukes further being formed with abutments bearing on said abutments of the respective arms in said extreme positions.

6. The anchor defined in claim 5, wherein each of said secondary flukes is formed with reinforcing ribs extending away from the respective arm and formed with the respective abutments.

7. The anchor defined in claim 1, wherein each of said arms is formed by a pair of spaced-apart substantially parallel rods and each of said secondary flukes has an edge extending between and past the respective pair of rods.

8. The anchor defined in claim 7, wherein each of said arms is provided at the ends of said rods remote from said shank with a rigid connecting element secured to the respective rod ends.

9. The anchor defined in claim 1, further comprising a second such stock on said shank carrying a second pair of such secondary flukes.

10. The anchor defined in claim 9, further comprising a weight displaceable along said shank between said stock and said flukes.

11. The anchor defined in claim 10, wherein said weight can be positioned on said shank at said crown end thereof.

12. The anchor defined in claim 10, wherein said weight has a center of mass and is formed with a throughgoing bore passing through said weight at a location spaced from said center of mass, said shank passing through said bore.

13. The anchor defined in claim 1, further comprising a second such pair of such main flukes lying generally in said stock plane.

* * * * *